US005318219A

United States Patent [19]

Smith

[11] Patent Number: 5,318,219

[45] Date of Patent: Jun. 7, 1994

[54] COLLAPSIBLE PALLET MOUNTED CONTAINER

[75] Inventor: Glenn M. Smith, Burton, Mich.

[73] Assignee: Four M Manufacturing Group of CPC, Inc., Flint, Mich.

[21] Appl. No.: 894,778

[22] Filed: Jun. 5, 1992

[51] Int. Cl.[5] ..... B65D 5/36

[52] U.S. Cl. ..... 229/117.05; 206/386; 206/600; 229/23 R

[58] Field of Search ..... 229/117.05, 23 R; 206/386, 600

[56] References Cited

U.S. PATENT DOCUMENTS

| | | | |
|---|---|---|---|
| 756,311 | 4/1904 | Adams | 229/117.05 |
| 3,026,015 | 3/1962 | Severn . | |
| 3,519,190 | 7/1970 | Achermann et al. . | |
| 3,565,325 | 2/1971 | Pugsley | 229/117.05 |
| 3,696,988 | 10/1972 | Nederveld | 229/23 R |
| 3,708,861 | 1/1973 | Hickey . | |
| 3,743,166 | 7/1973 | Heavner . | |
| 3,756,498 | 9/1973 | Anderson . | |
| 3,831,744 | 8/1974 | Walden et al. . | |
| 3,949,874 | 4/1976 | Heavner . | |
| 3,949,929 | 4/1976 | Kupersmit . | |
| 4,009,787 | 3/1977 | Beal . | |
| 4,085,846 | 4/1978 | Williams . | |
| 4,085,847 | 4/1978 | Jacalone . | |
| 4,089,417 | 5/1978 | Osborne . | |
| 4,119,205 | 10/1978 | Delany . | |
| 4,230,227 | 10/1980 | Kowall et al. . | |
| 4,350,099 | 9/1982 | Persson . | |
| 4,373,637 | 2/1983 | Shippell . | |
| 4,383,609 | 5/1983 | Lochmiller . | |
| 4,392,606 | 7/1983 | Fremion . | |
| 4,445,614 | 5/1984 | Mitsumori et al. . | |
| 4,454,946 | 6/1984 | Yokowo . | |
| 4,503,973 | 3/1985 | Andersson . | |
| 4,606,461 | 8/1986 | Bolton, Sr. . | |
| 4,676,373 | 6/1987 | Schneider . | |
| 4,694,962 | 9/1987 | Taub . | |
| 4,697,699 | 10/1987 | Schneider . | |
| 4,712,687 | 12/1987 | Silcott et al. . | |
| 4,756,469 | 7/1988 | Hansen . | |
| 4,760,922 | 8/1988 | Northgrave . | |
| 4,763,787 | 8/1988 | Koenig . | |
| 4,771,939 | 9/1988 | Wilkins . | |
| 4,776,481 | 10/1988 | Kidd . | |
| 4,793,507 | 12/1988 | Delplanque . | |
| 4,798,294 | 1/1989 | Bodi . | |
| 4,809,851 | 3/1989 | Oestreich, Jr. et al. . | |
| 4,817,824 | 4/1989 | LaFleur et al. . | |
| 4,830,191 | 5/1989 | Dijksman . | |
| 4,860,912 | 8/1989 | Kupersmit . | |
| 4,949,898 | 8/1990 | Nederveld | 229/23 R |
| 4,969,559 | 11/1990 | Nederveld | 206/600 |
| 5,090,614 | 2/1992 | Kupersmit | 229/117.05 |
| 5,163,555 | 11/1992 | West et al. | 206/600 |

*Primary Examiner*—Gary E. Elkins
*Attorney, Agent, or Firm*—Brooks & Kushman

[57] ABSTRACT

A collapsible corrugated fiberboard container to be fastened to a pallet. The container has a floor panel, two opposite side panels and two opposite end panels. The side panels and end panels are flexibly connected to each other, and the floor panel is connected to the bottom edges of the side panels. The floor panel is divided by a first score line into two central floor portions of equal length as measured transversely of the first score line and one of which is fixed to the pallet, and by a second floor score line common to the fixed central floor portion and forming an outer floor portion. The end panels are provided with vertical score lines. The bottom flaps are each connected to the bottom edge of the end panels and are also provided with score lines. The first floor score line is arranged approximately mid-way of the pallet. The container can be collapsed due to the flexible connections between the side panels and end panels and the arrangement of the floor score lines so that the container can assume a flattened storage configuration above the pallet when not in use, be of maximum depth when unfolded, and be folded completely within the confines of the pallet when collapsed.

16 Claims, 5 Drawing Sheets

COLLAPSIBLE PALLET MOUNTED CONTAINER

TECHNICAL FIELD

This invention relates to a collapsible container which is designed to be mounted to a pallet, and particularly to a collapsible container which is designed to collapse and be folded in a flattened configuration above the pallet for storage.

BACKGROUND OF THE INVENTION

It has been the common practice in certain shipping and storage practices to utilize various containers generally manufactured of corrugated fiberboard which are attached to a pallet. The pallets are generally manufactured of wood which is mounted on skids so that forklifts can approach the pallet in various directions and quickly and easily move the pallet. Such assemblies generally required a carton and pallet, each separate units. This necessitated assembly of the container and mounting it on the pallet for use. A significant amount of storage area was taken up if the containers were stored for reuse. The containers sometimes were disassembled or destroyed, in which case only the wooden pallets were reused.

Collapsible containers for use with pallets have previously been designed. Generally, some of these containers had the side walls or end walls collapsible, while the entire bottom of the container has been either totally affixed to the pallet or completely removable therefrom.

Another type of palletized container has the container and pallet both being made from corrugated fiberboard or the like with the pallet formed from the same blank as the container. See, for example, U.S. Pat. No. 3,026,015 to Severn and U.S. Pat. No. 3,519,190 to Achermann et al. Both of these patents illustrate a container having a pallet integrally formed with the container and able to be knocked down or folded for storage.

A disadvantage of containers which have a pallet as a part thereof is that they require a significant amount of assembly time and frequently more than one person to assemble. This severely lessens their desirability for use. Furthermore, the palletized containers having an integrally formed pallet can generally be approached with a forklift from only certain directions which is undesirable at times.

Another container which makes use of a standard pallet is illustrated in U.S. Pat. No. 4,085,846 to Williams. Although a standard pallet is used, the container is floorless and relies on a floor formed separately and attached to the pallet. This can result in a weakened container. The bottom floor generally adds structural support to the containers by keeping the side walls or end walls of the container from bulging outward and separating from the floor. This design does not provide for this support and the side walls can separate from the floor.

Another design which uses a standard pallet is illustrated in U.S. Pat. Nos. 3,743,166 and 3,949,874, both issued to Heavner. In these patents, the container is hingedly connected along one edge to an edge of a pallet. The container pivots around this edge either to a usable or storage position. A problem with the design shown in the '166 patent is that the surface area taken up by the container in the stored position is more than when in the opened position. This is due to the container pivoting away from the top of the pallet and thus takes almost twice the opened amount of surface area for storage. Thus, although the container is collapsed and takes less than the height which the assembled container takes, the storage configuration may still be unacceptable. Also, this design requires substantial time, effort and manpower to assemble the carton due to the numerous folds which must be made to assemble the completed carton.

Lastly, in U.S. Pat. No. 4,373,637, owned by the same assignee as the present invention, there is shown a collapsible container and pallet assembly which overcomes many of the disadvantages of the aforementioned container pallet assemblies. Most importantly, due to the configuration of the score lines, bottom flaps and floor panel, the container can be collapsed to a flattened storage configuration above the pallet. This is accomplished by basically providing the floor of the container with two parallel score lines, dividing the floor into a center position which is fixed to the pallet and two outer portions which are about the center portion as the container is opened and collapsed. Such a system works very well for most situations. The assembly cost to the user is kept to a minimum and the container is secure to the pallet. Further, the container-pallet assembly stores and stacks well within given container height limits. However, it was recognized that the utility of this design would be significantly enhanced if it permitted a container of greater height (or depth), and maintained the collapsed container within the confines of the pallet. Further, it was recognized that the stacking capabilities of the subject assembly might be enhanced if there were more of the container floor portion supporting the side panel in face-to-face contact.

SUMMARY OF THE INVENTION

The present invention contemplates a container having all of the following advantages:

1. Can be used with several different types of pallets; p0
2. Can be affixed to the top of a wooden pallet designed for reuse, or an inexpensively assembled corrugated fiberboard pallet designed for disposal;
3. Can be opened or collapsed easily by one person with the minimum number of fold or score lines required to achieve the object of simple and easy opening and closing;
4. Generally occupies approximately the same surface area in the collapsed position as it does when in the opened position;
5. Can be alternately stacked in a pile after collapsing the container so that more containers can be placed on top of one another thereby reducing the storage area required for collapsed containers;
6. Is inexpensive to manufacture due to the material it is constructed from and also due to the manner in which it is constructed;
7. Can be removed when it is no longer functional from a reusable pallet and a new container affixed to the same pallet thereby allowing a reusable pallet of sturdy construction to be used with several collapsible containers; and
8. Is of maximum depth in the opened condition.

The present invention also contemplates a container-pallet assembly which, in the collapsed condition, includes the container being maintained within the surface area of the pallet and providing maximum stability when stacked one upon the other.

The foregoing is accomplished by providing a collapsible container which is formed from corrugated fiberboard and is adapted to be fastened to a pallet. The rectangular container body is formed from a floor panel, side panels and end panels. There are two parallel score lines which divide the floor panel into two central portions and an outer portion which are adjacent the side panel bottom edges. One center portion of the floor panel is fastened to the top of the pallet and the other central portion and the outer portion are foldable along the score lines, each being flexibly connected to the bottom edges of the side panels as well. The outer portion is preferably of a minimum width equalling the combined thickness of a folded end panel. Further, the two central portions are of equal length as measured from side panel to side panel. There are two bottom flaps each flexibly connected to the bottom edges of the end panels. A vertical score line bisecting each end panel also bisects the respective bottom flap. When the container is in its opened position, the bottom flaps lie on top of the floor panel to give the floor of the container a multiple ply reinforced bottom. When the container is collapsed, the bottom flaps fold upward against the side panels, and the side panels and bottom flaps fold together along the score line inwardly in unison. Also, when the container is in the opened position, the floor portions are flush against the pallet top; when the container is in the collapsed position, the unattached central portion is folded upward about the score line until folded inward and collapsed horizontally upon the fixed central portion. The outer portion is then folded inward about the remaining score line, and with it the collapsed side panels and end panels, until the latter is horizontally collapsed in contact with the flattened unattached center portion. In this condition, the container is fully collapsed to a flattened storage configuration with the entire container being collapsed within the confines of the pallet.

Preferably also, the container will be laid out relative to the pallet such that the container is collapsed upon a floor score line extending across the least or minimum side-to-side dimension of the pallet, thereby allowing a collapsed container which, when unfolded to a fully opened condition, will provide a container of maximum depth.

Other objects and advantages of the invention will become apparent upon reading the detailed description and upon reference to the drawings.

BRIEF DESCRIPTION OF THE DRAWINGS

The invention will now be described by way of example and with reference to the accompanying drawings.

DESCRIPTION OF THE PREFERRED EMBODIMENT

Figure 1:
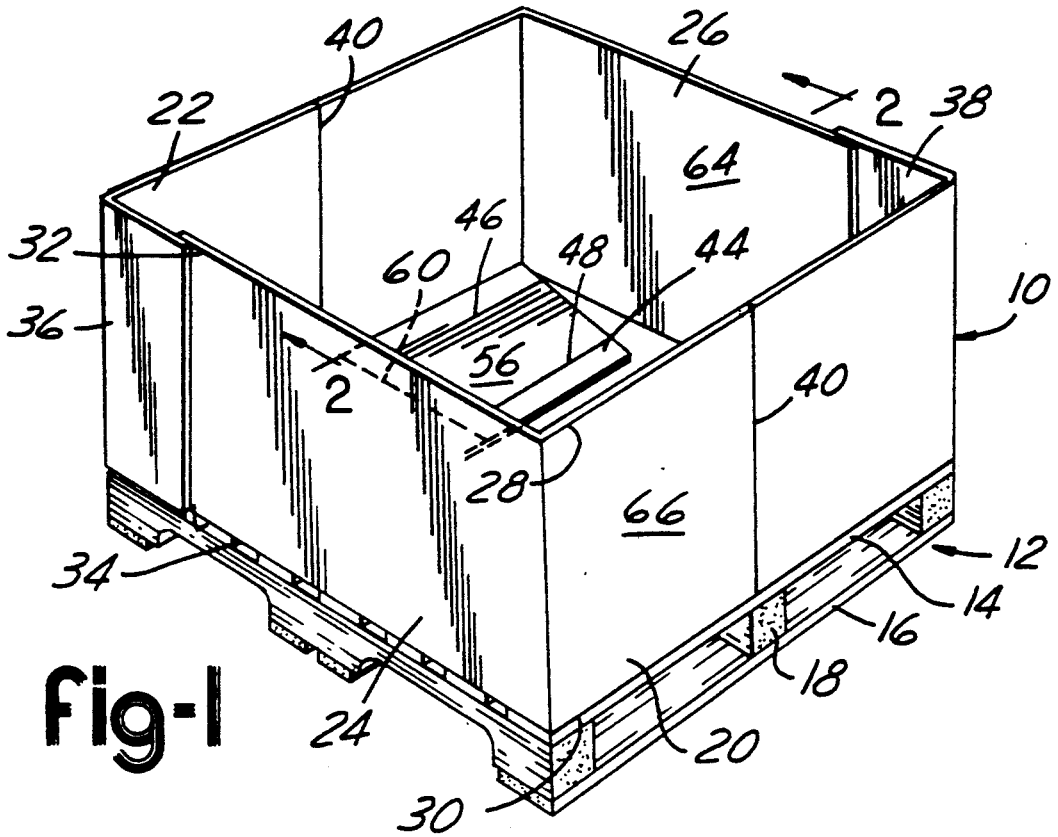
FIG. 1 is a perspective view of the collapsible container assembly and pallet in accordance with one embodiment of the present invention.
Figure 2:
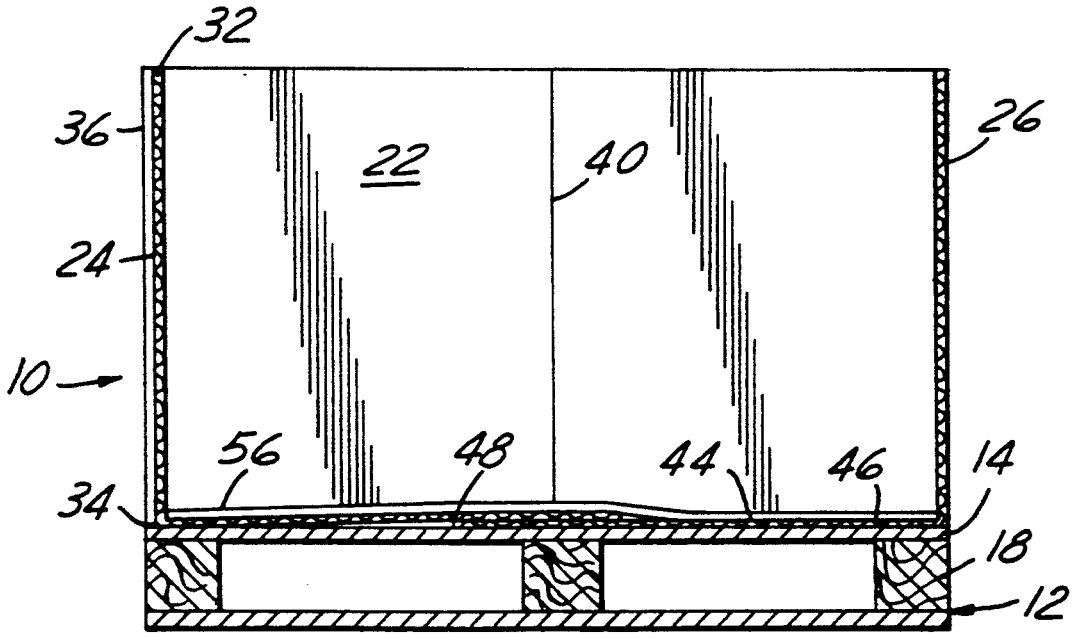
FIG. 2 is a cross-sectional view taken along lines 2—2 of FIG. 1.

Turning first to FIGS. 1 and 2, there is illustrated a collapsible container 10 affixed to a horizontal rigid pallet 12. The pallet 12 is of conventional design having a top 14 and bottom 16 separated by supports 18. The top and bottom can be made of either solid sheets of wood or slats. The spacing between supports 18 and the configuration thereof are such as to allow the entrance of forks from a lift truck to be placed between the top 14 and bottom 16 from any one of the four sides of the pallet 12. Although wood is the preferred material to manufacture the pallet 12, other rigid materials could be used.

The container 10 preferably is made from corrugated paper material and preferably is one-ply in thickness. It is also possible to use two-ply or three-ply corrugated material for the container, or a one-ply with a double wall liner laminated to the side and end panels. With the present invention, it is possible to use corrugated materials of more than one-ply and still allow the container to remain substantially flat when collapsed. This permits greater flexibility and height when stacking and minimizes the space necessary for storage.

Figure 3:
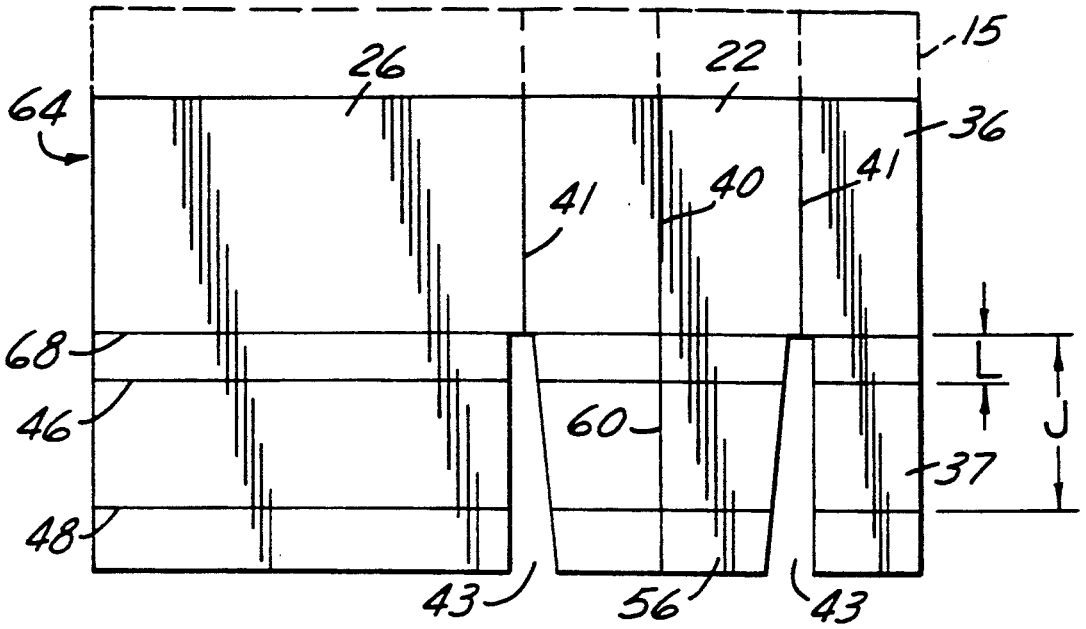
FIG. 3 is a plan view of the blank used to construct the collapsible container illustrated in FIG. 1.

The container 10 has four flexibly interconnected wall panels illustrated as two opposite end panels 20 and 22, and two opposite side panels 24 and 26. Each end panel has top and bottom edges 28 and 30. Each side panel has top and bottom edges 32 and 34. Flexible connections at the bottom edges 30 and 34 are made by scoring and folding the container material to form the bottom of the container, as will be more fully described below. A flexible connection at each of the corners can be accomplished by scoring and folding the container material when forming the container from one continuous piece, or by flexibly joining two or more separate container blanks. The flexible connections in the preferred design shown in FIG. 1 between panels 20, 22, 24 and 26 are made by scoring and folding two separate and identical corrugated fiberboard container material blanks, one of which is illustrated in FIG. 3.

All of the panels have inner and outer surfaces, the inner surface of a panel being that side located towards the center of the container 10, and the outer surface on the opposite side.

Each end panel 20,22 has a vertical score line 40 extending between the top edge 28 and bottom edge 30 of their respective side panels 20 and 22. The purpose of the vertical score lines will be discussed in detail below.

Figure 5:
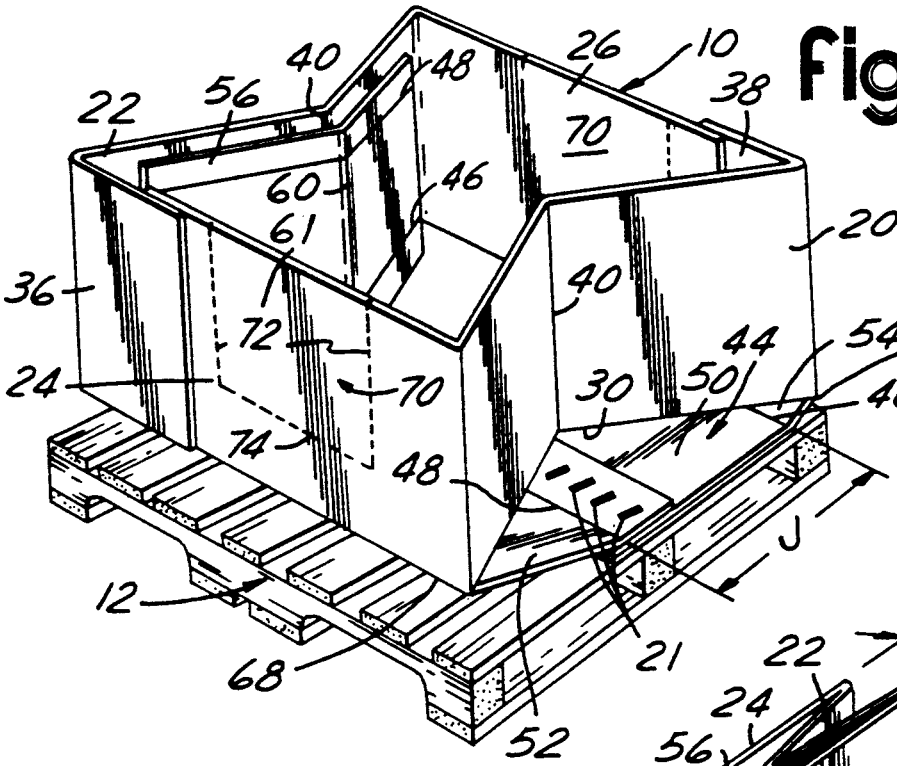
FIG. 5 is a plan view of the container shown in FIG. 4 in the partially collapsed position.
Figure 6:
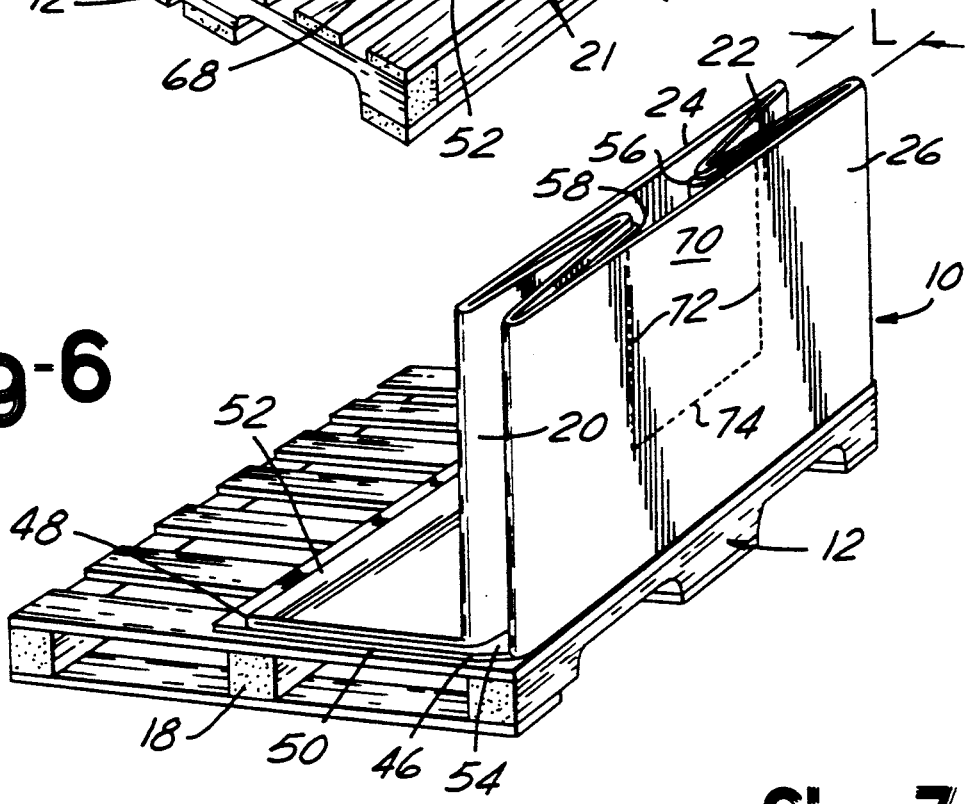
FIG. 6 is a perspective view of the container shown in FIG. 5 in a further stage of collapse.

The container 10 has a floor 44 which is affixed at specific locations to the top 14 of the pallet 12 after being centered. As better seen in FIG. 5, the floor 44 is divided by score lines 46 and 48 into two central portions 50 and 52 and a outer portion 54. Central portion 50 is defined as the area between the two score lines 46 and 48. Central portion 52 is defined as the area between floor score line 48 and the score line 68 which constitutes the bottom edge 34 of side panel 24. The outer portion 54 is the floor area bounded by the score line 46 and the bottom edge 34 of side panel 26. As seen in FIGS. 5 and 6, central portion 50 is the only portion of the floor 44 which is fastened to or affixed to the top 14 of the pallet 12. The method of fastening can be adhesives or glues, but it would be most practical to use staples 21 which could easily pass through the corrugated fiberboard floor 44 and be driven into the top 14 of the pallet 12. This would also permit the container to be easily removed and replaced with a new container if desired.

The score lines 46 and 48 are parallel to each other and parallel to the bottom edge 34 of the side panels 24 and 26. The connection between outer portion 54 and the side panel 26 is also a flexible connection which can easily be accomplished by means of scoring and folding a continuous piece of corrugated fiberboard. Again, if separate corrugated board pieces are used, stitching would be preferred.

Flexibly connected to the bottom edge 30 of the end panels 20,22 are bottom flaps 56,58 which lie on top of floor 44 when the container is erected. Each bottom flap 56,58 is bisected by a score line 60 which extends perpendicular from the bottom edge 30 of the respective end panel 20,22 to the end of the bottom flap. The score line 60 forms an extension of the vertical score line 40, as can be best seen in FIG. 3.

The container 10 can be manufactured from a single blank or two or more blanks. As illustrated in FIGS. 1–7, the container 10 comprises two identical blanks 64,66, the particular structure of each and assembly being shown in FIGS. 3 and 4. For convenience only blank 64 is illustrated in FIG. 3. The reference numerals used in FIG. 3 for the side panel, end panel connecting flap, and bottom flap pertain to that particular blank.

Despite the blanks 64,66 being identical and the respective score lines of each blank being identically laid out on the blank, as noted below, not every score line is functional on each blank when the container is folded for storage. Nor is each functional in the same manner when the two blanks are formed to comprise the collapsible container 10. Specifically, the score line 46 across side panel 24 is not functional nor is the score line 48 across side panel 22 functional. Further, neither of score lines 46 and 48 across the bottom flaps 56,58 are functional.

Figure 4:
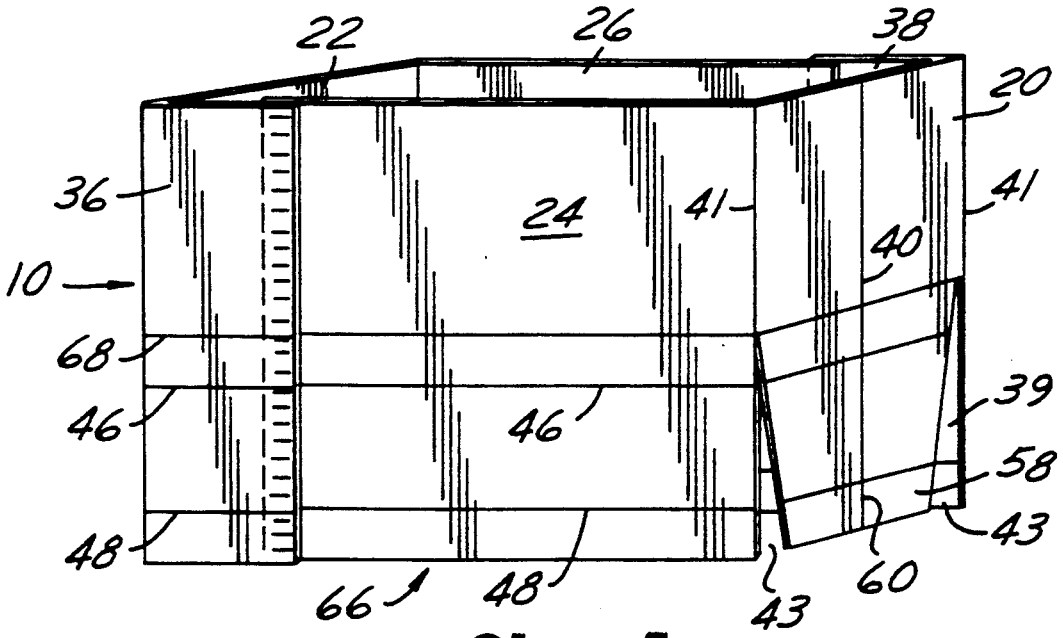
FIG. 4 is a perspective view of the collapsible container as assembled utilizing two of the blanks illustrated in FIG. 3 and prior to assembly to a pallet.

It can be seen that the vertical score line 40 bisects the end panels 20,22 respectively. The flexible connections between the side panels 24,26, including that portion defined by the connecting flaps 38,36, respectively, and the outer portion 54 are made by means of score line 68. Score line 68 also provides the flexible connection between end panels 20,22 and the respective bottom flaps 58,56. As best seen in FIGS. 4 and 5, the bottom portions 37 and 39 of corner flaps 36 and 38 below score line 68 fold in to form a portion of floor 44. The score line 60 bisects the bottom flaps 56,58 and is in alignment with the vertical score line 40.

Extending across each blank 64,66 and parallel to score line 68 is a further pair of score lines 46 and 48, previously described. Due to generally available manufacturing equipment, the score lines 46 and 48 extend across and score the bottom flaps 56,58, but the flaps 56 and 58 are not folded on these extended score lines. The same is true for other portions of the score lines as earlier described.

Looking at FIGS. 3 and 4, vertical score line 41 is formed in each blank 64,66 to define the flexible connections constituting the corners of the box which are the junctures of the respective side panels and end panels 24,26 and 20,22.

For purposes which are made more evident below, score lines 46 and 68 are spaced from one another a distance "L". This distance "L" equals the folded width or thickness of the container as measured from the outside wall of one side panel to the outside wall of the other side panel as shown in FIG. 6. As stated otherwise, it equals the thickness of six panels of corrugated paper. Score line 68 is spaced from score line 48 a distance "J". Again as explained more fully below, this distance "J" also equals the effective folded length of each central portion 50,52.

Lastly, each blank 24,26 is provided with a pair of vertically extending slots or gaps 43 between a respective side of the bottom flaps 56,58 and the adjoining edge of that portion of each blank lying below score line 68 which forms a portion of floor 44. It will be noted that each such adjoining edge is nearly vertically coextensive with score line 41. The width of gap 43 is sufficiently wide to ensure that there will be no interference of the side edges of bottom flaps 56 and 58 with the inside surface of the side panels of the container.

The container 10 is generally manufactured at a central manufacturing location which assembles the blanks 64,66 into containers which are fastened to the pallet 12. The connecting flap 36 of blank 64 is affixed by stitching, gluing, or otherwise securing it to the edge of the side panel 24 of blank 66. The connecting flap 38 of blank 66 is affixed to the edge of the side panel 26 of blank 64 in the same manner. The blanks are then folded along score lines 68 and the central portions 50 are positioned over one another and preferably stapled to the top 14 of the pallet 12 in a manner that squares (centers) the floor 44 with the edges of the pallet.

The length of the side panel bottom flaps 56,58 and end panel bottom flaps as measured from the score line 68 to the bottom edge of the blank 64,66 is just over ½ the length of the pallet to which the container is to be secured. Thus, as the container as seen in FIG. 4 is to be affixed to the pallet, the bottom flaps of side panels 24,26 will be folded inwardly and will overlap one another. As seen particularly in FIGS. 2 and 5, a row of staples 21 is then installed through the overlapped portions of the bottom flaps. The staples run parallel to score line 48 of central portion 52. The other score line 48, namely that of the covered bottom flap of side panel 26, as well as score line 46 extending across the central portion 52, are not functional as mentioned earlier when the container is folded in the above manner.

To collapse the container of FIG. 1, the bottom flaps 56,58 which are oriented above and in contact with the floor 44, are raised along score line 68 until the top surface of the bottom flaps contacts the inner surface of the end panels 20,22, as best seen in FIGS. 5 and 6. The end flaps 20,22 are then folded inwardly along the vertical score line 40 which is in alignment with the score line 60 of the end panel bottom flaps 56,58. The end panels and bottom flaps are folded together in unison until each flap and panel pair is collapsed flat upon itself as seen in FIG. 6.

Figure 7:
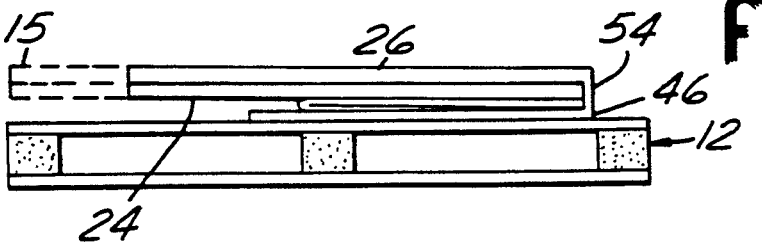
FIG. 7 is an end view of the container and pallet with the container in the fully collapsed storage position.

Simultaneous with the inward folding of the end panels and bottom flaps, central portion 52 is pivotally raised up from contact with the top 14 of the pallet 12. Outer portion 54 may also raise up from contact with pallet 12 particularly after repeated use, but whether it does or not is unimportant. The central portion 52 folds along score line 48 until collapsed face-to-face with central portion 50 as seen in FIG. 6. At this point, the side walls 24,26 and folded end walls 20,22 will also be fully collapsed in face-to-face contact and vertically disposed within the confines of outer portion 54. Then, as seen in FIG. 7, the collapsed side walls and end walls are then folded inwardly about score line 46 to a horizontally collapsed state. The collapsed walls of the container are thereby stored in a substantially horizontal plane which is substantially parallel to the plane of the top of the pallet 12.

The height of the container 10 is that dimension or distance between the top and bottom edges of the end panels and side panels. Looking at FIG. 7, it will be evident that the container assembly design permits as a maximum container height that which is obtained by extending the top edge of the end panels and side panels to a point terminating at the edge of the pallet 14 as shown in dotted lines 15. It will also be evident that this freedom in selecting a container height adds greatly to the design utility and customer appeal. Further, the greater the container height, the more stable is the container-pallet assembly when stacked.

To assist in allowing manual placement and removal of items from the bottom or floor of an assembled container 10, it si possible to allow a portion 70 of one or more of the side panels to be opened and folded out of the way. For this purpose, additional score or perforation lines 72, 74 can be provided on the side panels 24, 26, as shown in FIGS. 5 and 6. (Although the lines 772, 74 are shown only in FIGS. 5 and 6, this is just for illustrative purposes; if optional portions 70 and score/-perforation lines are desired, they would be present in all of the views, and also could be used with the alternate embodiment shown in FIGS. 8–12 in the same manner.) For use of the "side flap" or "drop panels" 70, the two score/perforation lines 72 would be cut or separated from the side panels and the portions 70 folded either inwardly or outwardly along score line 72. This would also allow easier manual access to the bottom of the container. Once access is no longer necessary, the drop portions 70 can be returned to their original positions (flush with the plane of side panels 24, 26) and held in place by tape or the like.

With the flat, substantially horizontal orientation of the collapsed container in accordance with the present invention (as shown in FIG. 7), it is possible to stack and store more of the containers on top of one another, without danger of tipping or sliding off. This is particularly important when double and triple wall corrugated materials are used for the containers.

Most pallets in use today are rectangular in shape, although the length of the pallet is not significantly greater than the width. To maximize on the height of the container which could be collapsed on the pallet, it is preferred that the container be dimensioned and affixed to the pallet such that the floor score lines 46,48 run transversely of the smaller dimension of the pallet. Thus, when folded, the side walls and end walls will extend across the maximum dimension or length of the pallet. The only limitation on this design is that the inwardly collapsed end walls must not come in contact with or interfere with one another. Further, it may require that the end panel bottom flaps 56,58 overlap one another on floor 44 or that the length of each as measured across the end panels be shortened.

In FIGS. 8–12, there is shown another embodiment of the present invention which shows a container made of two blanks 80 and 82 of substantially similar, yet not identical structure. In the description which follows, like reference numerals are used where the structure of the container or container-pallet assembly is identical to the first embodiment of FIGS. 1–7. What is most evident is that each score line on each blank is functional. Further, the bottom edges of the bottom flaps constituting the floor portion 44 are cut and laid out on the pallet so as to abut one another rather than overlap, as was the case with the first embodiment. Moreover, the connecting flaps are seen to make up a portion of the end panels rather than the side panels. Other than these distinctions, the second embodiment is affixed to the pallet and collapses on the pallet in the same manner as described in connection with the first embodiment of FIGS. 1–7.

Figure 8:
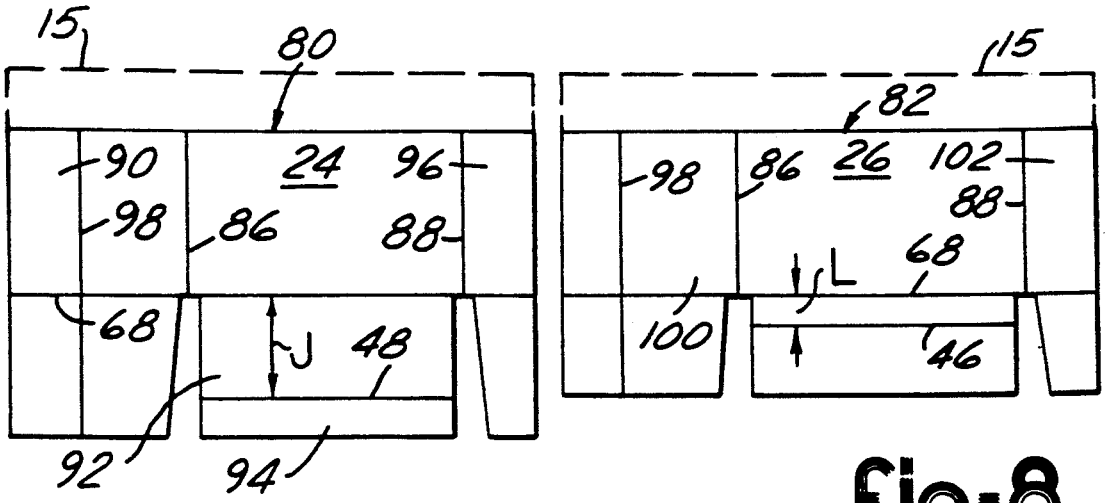
FIG. 8 is a plan view of two dissimilar blanks used to construct the collapsible container in accordance with an alternate embodiment of the present invention.

More specifically, as seen in FIG. 8, the container includes two blanks 80 and 82. Blank 80 includes a side panel 24 defined by vertical score lines 86 and 88 and horizontal score line 68. It further includes a bottom floor flap 92 forming a major portion of floor 44 and extending from score line 68 to the bottom edge 94. Vertical score lines 86 and 88 are fold lines for forming a portion of each end panel 20,22 from the side wall. A major portion 90 of end panel 22 is disposed to the side of vertical score line 86 and a minor portion 96 of the end panel 20 is disposed to the side of vertical score line 88. A further vertical score line 98 extends across the major portion 80 of end panel 22 in a manner bisecting the composite end panel 22.

Figure 9:
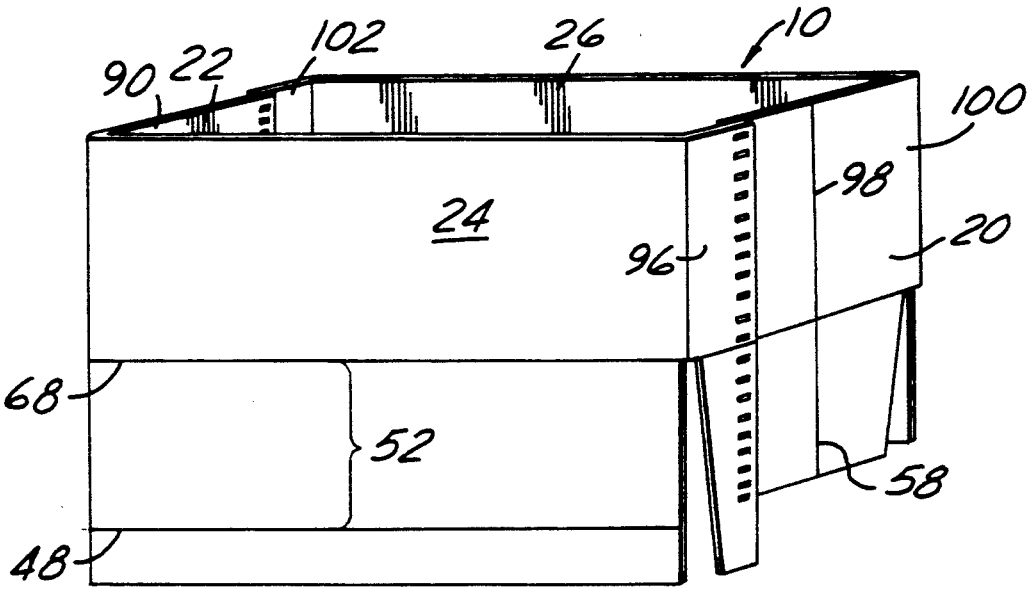
FIG. 9 is a perspective view of the collapsible container as assembled utilizing the two blanks illustrated in FIG. 8 and prior to assembly to a pallet.
Figure 10:
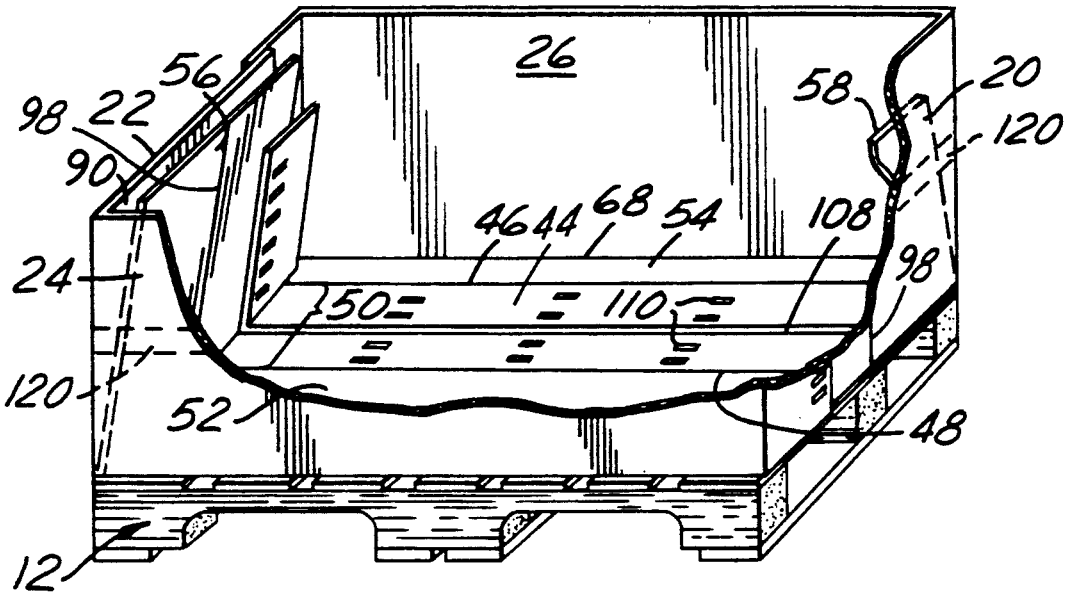
FIG. 10 is a perspective view of the collapsible container shown in FIG. 9 as assembled to a pallet in accordance with the present invention.
Figure 11:
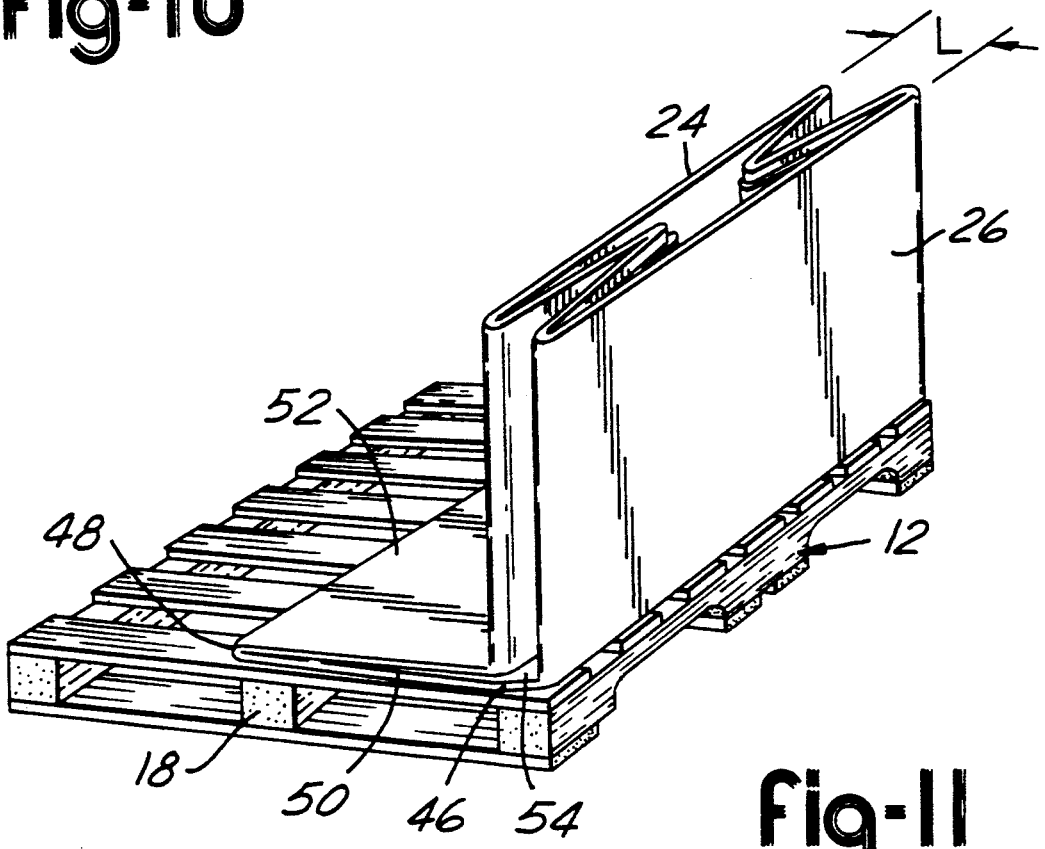
FIG. 11 is a perspective view of the container and pallet assembly shown in FIG. 10 in a partially collapsed position.

Lastly, as horizontal score line 48 extends across bottom flap 92, the distance "J" between score line 68 and score line 48 is equal to the length of central portion 52 as seen in FIGS. 9–11.

Similarly, blank 82 includes side wall 26 as disposed between vertical score lines 86 and 88 constituting the corners of the folded container. A major portion 100 of end panel 20 is disposed to the side of score line 86 and a minor portion 102 of end panel 22 is formed to the side of vertical score line 88. Vertical score line 98 bisects the composite end panel 20 forming a fold for the collapsed box as explained later. Lastly, score line 46 extends the full length of floor bottom flap 104 and is spaced a distance "L" from score line 68.

As seen in FIG. 9, the container is assembled by stitching the minor portions 96,102 of the end panels, which constitute connecting flaps of the respective blanks, to the corresponding major portions 100 and 90, respectively, of the end panels 22 and 20, respectively. As stated above, it is also possible to glue or otherwise affix the flap portions together as is well known in the art.

Looking at FIG. 10, the container assembly 10 is affixed to the pallet in much the same way as with the first embodiment with the exception that as the floor bottom flaps 92,104 of the side panels are folded inwardly, their edges are caused to abut one another as shown at 108, and each respective flap is then stapled in rows 110 to the pallet top 18 inwardly of or within the score lines 48 and 46. That portion of the composite floor panel 44 lying within the boundaries of score lines 46 and 48 and affixed to the pallet constitutes central floor portion 50. The length of central floor portion 50, i.e. the distance between score lines 46 and 48 equals the length of central floor portion 52 of the embodiment discussed earlier. That portion of floor panel 44 lying between score line 46 and the corner of floor portion 44 and side panel 26, namely score line 68, constitutes outer floor portion 54.

Figure 12:
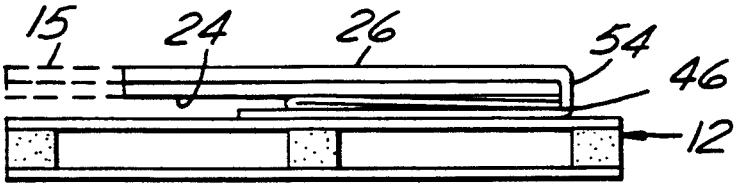
FIG. 12 is an end view of the container and ppallet assembly shown in FIG. 11 in the fully collapsed storage position.

To collapse the container of FIG. 10, the same procedure is followed as with respect to the container of FIGS. 1–7. It will be noted that central portion 52 collapses about score line 48 to fold down upon fixed central portion 50. The collapsed end panels 20,22 and side panels 24,26, as vertically oriented, occupy thickness "L" and thus, fall within the width of outer floor portion 54. Upon further collapsing the end panels and side panels to the horizontal position as shown in FIG. 12, the collapsed end panels and side panels will fold along score line 46 in the same manner as described in connection with the container assembly of FIGS. 1–7.

The depth of the container plus the inside flanges can be up to 85% or less of the width of the pallet. This allows the height and storage capacity of the container to be maximized and at the same time, allows the outer perimeter of the collapsed and folded container to stay within the confines of the edges of the pallet 12.

In order to increase the stability of the container when used with heavy items and/or to prevent the side panels of the container from "bulging" out, it is possible to include reinforcing members 120 in the panels of the container. These reinforcing members 120 (a/k/a "belly bands") are made from reinforced nylon strips and are included within the corrugated sheet materials when they are manufactured. Although the reinforcing members 120 are shown in the drawings only with respect to FIG. 10, this is only for illustrative purposes and the members would be visible or the subject of hidden lines in other Figures. Similarly, reinforcing members could be used in the embodiment shown in FIGS. 1–7.

Thus, if is apparent that there has been provided in accordance with the invention, a collapsible pallet mounted container that fully satisfies the objects, aims and advantages set forth above. While the invention has been described in conjunction with specific embodiments thereof, it is evident that many alternatives, modifications, and Variations will be apparent to those skilled in the art in light of the foregoing description. For example, the container 10 could be manufactured from one blank or more than two if desired, depending on the manufacturing equipment available, the needs of the user and other manufacturing variables. Accordingly, it is intended to embrace all such alternatives, modifications and variations as fall within the spirit and broad scope of the appended claims.

What is claimed is:

1. A collapsible container assembly comprising:

a horizontal rigid pallet base;

four flexible interconnected wall panels comprising two opposite side panels each having a top edge and a bottom edge and two opposite end panels each having a top edge and a bottom edge;

a container floor comprising at least two floor panel members, each floor panel member having first and second floor score lines parallel to each other dividing the floor into two central floor portions of substantially equal size and outer floor portions adjacent said central portions and extending to said side panels;

the container floor panel members each being integrally and flexibly connected to the bottom edges of the two opposite side panels;

one said central portion being affixed to the rigid pallet and the other central portion being foldable along the first floor score line;

vertical score lines dividing the two opposite end panels into two sections, whereby the two sections on each side of the vertical score lines on each of the two opposite end panels are foldable inwardly along the vertical score lines from an opened position to a collapsed position; and the floor score lines and the side score lines and the vertical score lines all forming flexible connections allowing the container to be collapsed in a flattened configuration above the pallet for storage.

2. The collapsible container of claim 1 wherein said outer floor portion is substantially equal in width, measured transversely of the bottom edge of one of said side panels, to the thickness of one said end panel as folded along said vertical score line.

3. The collapsible container of claim 2 and further comprising two bottom flaps each flexible connected to the bottom edge of one of the two opposite end panels.

4. The collapsible container of claim 3 wherein each of the two bottom flaps has a bottom score line aligned with the vertical score line on the respective end panels connected to the bottom flap, so that when the container is collapsed, each bottom flap is foldable upwardly until the bottom flap is facing the respective end panel connected thereto, and then foldable inwardly along the bottom score line of the bottom flap and vertical score line of the respective end panel connected thereto.

5. The collapsible container of claim 2 wherein the container is formed from two blanks of the same size.

6. The collapsible container of claim 5 wherein each blank comprises one of the side panels, one of the end panels, one of the bottom flaps and one of said container floor panel members.

7. The collapsible container of claim 6 and further comprising connecting means between the blanks.

8. The collapsible container of claim 7 wherein the connecting means comprises a corner flap on each said blank and means for fastening the corner flap of each blank to the other blank.

9. The collapsible container of claim 3 wherein each bottom flap is polygonal having its length along the bottom edge of the end panel to which the bottom flap is flexibly connected, and side edges substantially perpendicular to its length, with the end panels having a height defined by the top and bottom edges of the end panel and a length perpendicular to the height and defined by the interconnections with the side panels, the length of the end panels being longer than the length of the bottom flaps, and the end panels extending beyond the bottom flaps to provide clearance between the side edges of the bottom flaps and the interconnections between the end panels and side panels when the container is collapsed.

10. The collapsible container of claim 1 wherein the container is formed of corrugated paper board.

11. The collapsible container of claim 3 wherein the vertical score lines divide the two opposite end panels into two equal sections and the bottom score lines divide the two bottom flaps into two equal sections.

12. The collapsible container of claim 2 wherein said container floor is substantially equal in dimension and shape to said pallet base, said container floor and said pallet base being rectilinear, said one central floor portion being affixed to the pallet base along a central axis dividing said pallet base into two equal support positions, said floor score line common to the two central floor portions lying adjacent to said central axis opposite said outer floor portion, whereby the two central floor portions can be folded upon one another, and whereby the container can be collapsed by causing said side panels to collapse about the second floor score line to a flattened position resting upon said other central floor portion.

13. The collapsible container of claim 12 wherein said central axis extends in the direction of the greatest dimension of said pallet base, said two opposite end panels and said bottom flaps extending towards one another when the container is collapsed to a point short of said bottom flaps contacting one another in interference at said vertical score lines, whereby for any given pallet base size, the height of the container in the unfolded condition will be at a maximum permitting collapsing of the container within the confines of the pallet base.

14. A collapsible container to be fastened to a pallet, the container formed from corrugated paper board and comprising:

a polygonal carton body formed from two floor panels, two opposed side panels and two opposed end panels, the side and end panels each having a top edge and a bottom edge;

each of said side panel bottom edges being integrally and flexibly connected to a floor panel;

each of said floor panels having first and second floor score lines parallel to each other dividing said floor panels into first and second central floor portions of substantially equal size and an outer floor portion adjacent one of said central floor portions and extending to one of the side panels;

each of said first central floor portions being affixed to the pallet and each of said second floor portions foldable along the first parallel score line from an opened position, in which the second floor portion and the outer floor portion are in face-to-face contact with the pallet base, to a collapsed position, in which the second floor portion and the outer floor portion are folded along the first and second parallel score lines, respectively;

the end panels flexibly connected to the side panels, each end panel bisected into two end panel portions by a vertical end panel score line extending from the top edge of the end panel to the bottom edge of the end panel, each end panel portion having an inner surface and an outer surface, the two end panel portions co-planar when the container is in the opened position, and foldable inward along the vertical score line until the outside surfaces of the two end panel portions are in face-to-face contact when in the collapsed position;

bottom flaps flexibly connected to each of the bottom edges of said end panels;

each bottom flap bisected by a bottom flap score line which is contiguous and aligned with the vertical score line on the end panel connected to the bottom flap; and each of said bottom flaps oriented above and in contact with at least one of said floor panels when the container is in the opened position, and foldable upward by means of the flexible connection to the bottom edges of the end panels, until the bottom flaps contact the inner surfaces of the end panels, the bottom flaps then foldable inwardly along the bottom flap score lines in unison with the inward folding along the vertical score lines of the end panels when in the collapsed position, whereby the opened rectangular container can be collapsed to a flattened storage configuration above the pallet for storage.

15. The collapsible container of claim 14 wherein said outer floor portion is substantially equal in width measured transversely of said second parallel floor score line to the thickness of one said end panel as folded along said vertical score line.

16. The collapsible container of claim 15 wherein the bottom flaps are not in contact with the side panels when the container is in the opened or collapsed configuration.

* * * * *

UNITED STATES PATENT AND TRADEMARK OFFICE

CERTIFICATE OF CORRECTION

PATENT NO. : 5,318,219

DATED : June 7, 1994

INVENTOR(S) : Glenn M. Smith

It is certified that error appears in the above-identified patent and that said Letters Patent is hereby corrected as shown below:

Column 2, line 40; "p0" should be deleted;

Column 4, line 13; "ppallet" should be -- pallet --;

Column 7, line 32; "si" should be -- is --;

Column 7, line 36; "772" should be -- 72 --;

Column 9, line 39; "if" should be -- it --;

Column 9, line 45; "Variations" should be -- variations --.

Signed and Sealed this

Third Day of January, 1995

Bruce Lehman

*Attest:*

BRUCE LEHMAN

*Attesting Officer*

*Commissioner of Patents and Trademarks*